United States Patent [19]

Sessa et al.

[11] Patent Number: 4,865,881

[45] Date of Patent: Sep. 12, 1989

[54] APPARATUS AND PROCESS FOR MAKING LOCKING SLIDE NUTS

[75] Inventors: Eugene D. Sessa, Mt. Clemens; Richard Duffy, Utica, both of Mich.

[73] Assignee: Nylok Fastener Corporation, Rochester, Mich.

[21] Appl. No.: 225,527

[22] Filed: Jul. 28, 1988

Related U.S. Application Data

[63] Continuation of Ser. No. 11,148, Feb. 5, 1987, abandoned.

[51] Int. Cl.[4] ..... B05D 3/06

[52] U.S. Cl. ..... 427/181; 427/195; 118/308; 118/312; 10/10 P; 10/10 R

[58] Field of Search ..... 427/185, 195; 118/308, 118/312, 317; 411/1, 301, 258, 903; 10/10 P, 10 R

[56] References Cited

U.S. PATENT DOCUMENTS

| | | | |
|---|---|---|---|
| 3,830,902 | 8/1974 | Barnes | 118/308 X |
| 3,975,787 | 8/1976 | Newnom | 10/10 P |
| 4,100,882 | 7/1978 | Duffy et al. | 118/308 X |
| 4,262,038 | 4/1981 | Wallace | 427/181 |

*Primary Examiner*—Shrive Beck

*Attorney, Agent, or Firm*—Niro, Scavone, Haller & Niro, Ltd.

[57] ABSTRACT

An apparatus and method for applying locking material to an area of a fastener adapted for internal threading. The apparatus includes a support structure for moving a succession of internally threadable fasteners with support structure recesses positioning the fasteners for treatment. The fastener opening is filled with locking material and the fastener heated to soften the locking material and cause adherence to the internal walls of the fastener. A clearance pin can be used to selectively clear a passageway through the locking material either before or after the heating step. A gas pressure source directs a gas stream toward the opening of the fastener to form a passageway through the locking material attached to the fastener.

16 Claims, 4 Drawing Sheets

APPARATUS AND PROCESS FOR MAKING LOCKING SLIDE NUTS

This application is a continuation of 07/011,147 filed 2/5/87 now abandoned.

The present invention generally relates to an improved apparatus and process for the manufacture of threadable nuts having locking material applied to the area adapted for thread formation. More particularly, the invention relates to a method and apparatus for making threadable slide nuts using an automated system which (a) aligns the slide nuts in recessed portions of a rotating conveyer, (b) fills the slide nut opening with locking material, (c) removes unwanted locking material from the slide nuts, (d) heats the slide nut to melt the locking material to the inside nut walls and a portion of the throat area and (e) removes residual locking material from the slide nut chimney portion to form a clear passageway.

Prior art methods and apparatus are generally directed to systems having a rotatable table for receiving nuts and transporting them through a plurality of stations to effect application of resin or locking material from a moveable conduit which sprays the locking material onto the threads of the nuts (see, for example, U.S. Pat. Nos. 4,054,688; 4,100,882 and 4,366,190 which are incorporated by reference herein). These patents are directed to the selective application of locking material to portions of the threads of a nut. However, the structural components of the apparatus in these various patents are complex. Furthermore, such apparatus is generally unable to completely cover the entire threaded area and requires additional mechanical components to implement coverage of the threaded area.

It is therefore an object of the invention to provide an improved method and apparatus for covering all the threaded area of an internally threadable fastener.

It is another object of the invention to provide a novel method and apparatus for covering all the threadable area of a slide nut.

It is an additional object of the invention to provide an improved method and apparatus for applying locking material to all the threadable area of a nut and subsequently controllably remove residual locking material from the nut.

For a fuller understanding of the nature and objects of these inventions reference should be made to the following detailed description taken in conjunction with the accompanying drawings, wherein like reference numerals denote corresponding parts throughout the several views.

DETAILED DESCRIPTION OF PREFERRED EMBODIMENTS

Figure 1:
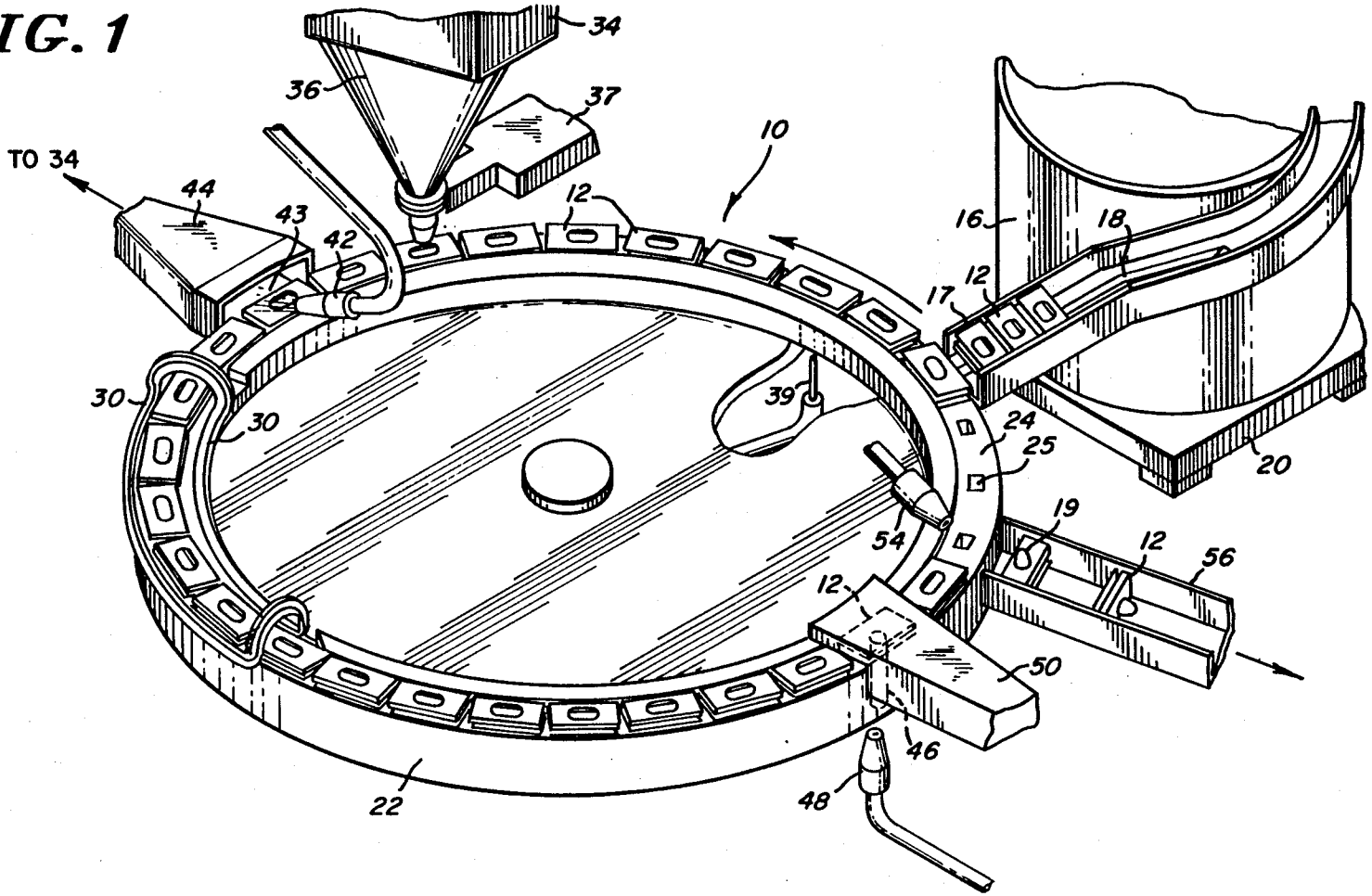
FIG. 1 illustrates a perspective view of an apparatus constructed in accordance with one embodiment of the invention.
Figure 2A:
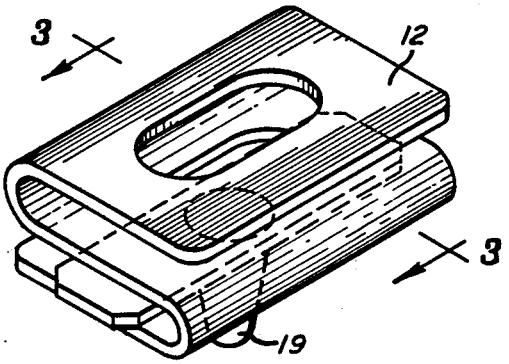
FIG. 2A is a perspective view of an internally threadable slide nut fastener of the type treated by the apparatus of FIG. 1.
Figure 2B:
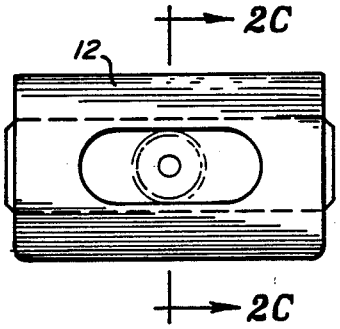
FIG. 2B is a plan view of the slide nut of FIG. 2A.
Figure 2C:
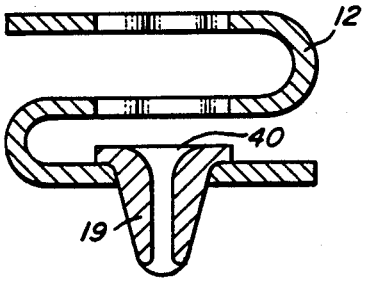
FIG. 2C is a cross sectional view taken along line 2C—2C in FIG. 2B.
Figure 2D:
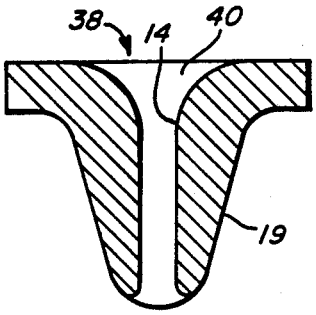
FIG. 2D is an enlarged partial cross sectional view of the opening of the throat portion of the slide nut of FIG. 2.
Figure 4A:
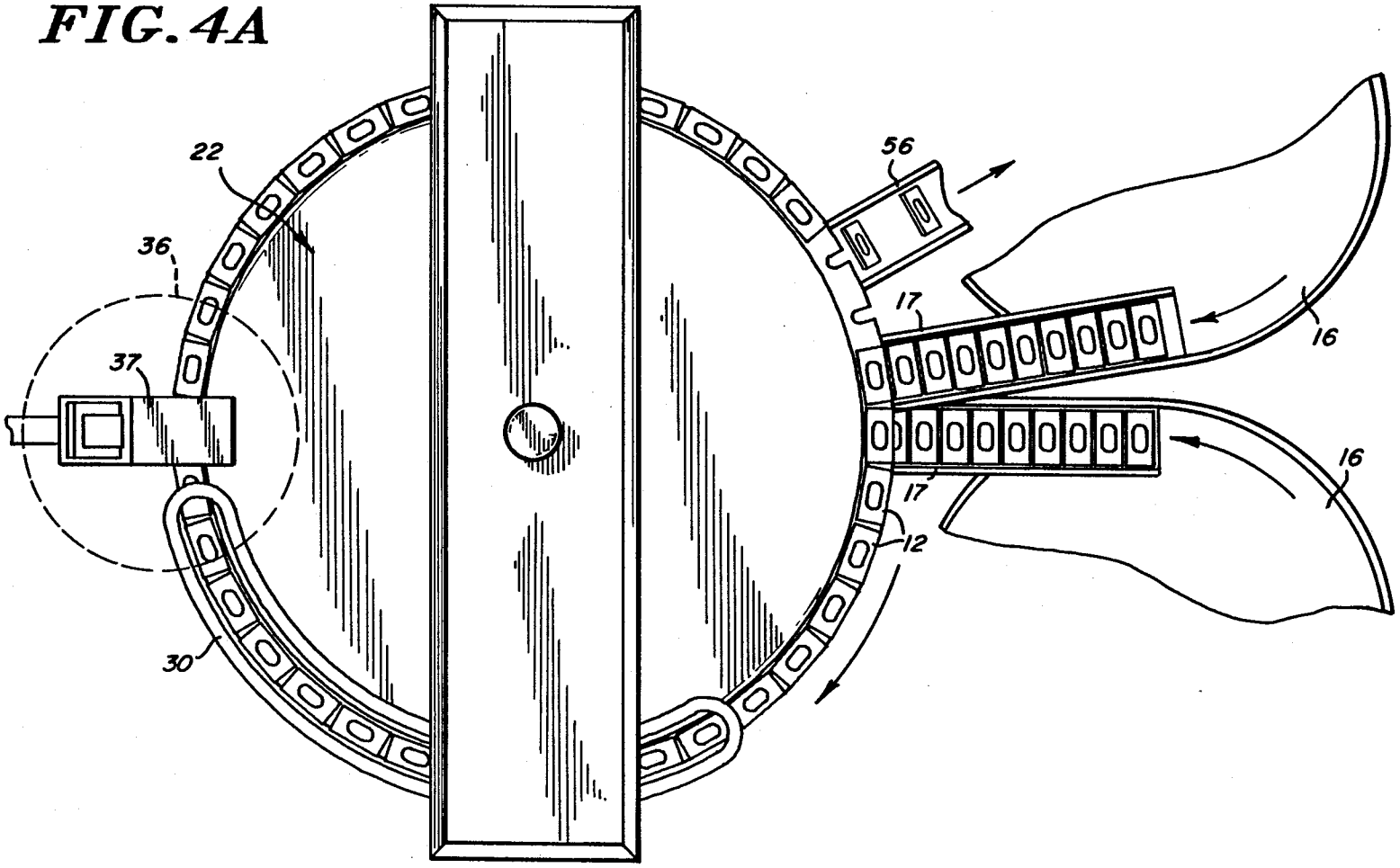
FIG. 4A is a plan view of an apparatus constructed in accordance with one embodiment of the invention having two separate treatment sections and FIG. 4B is a side elevation view of the embodiment of FIG. 4A.
Figure 4B:
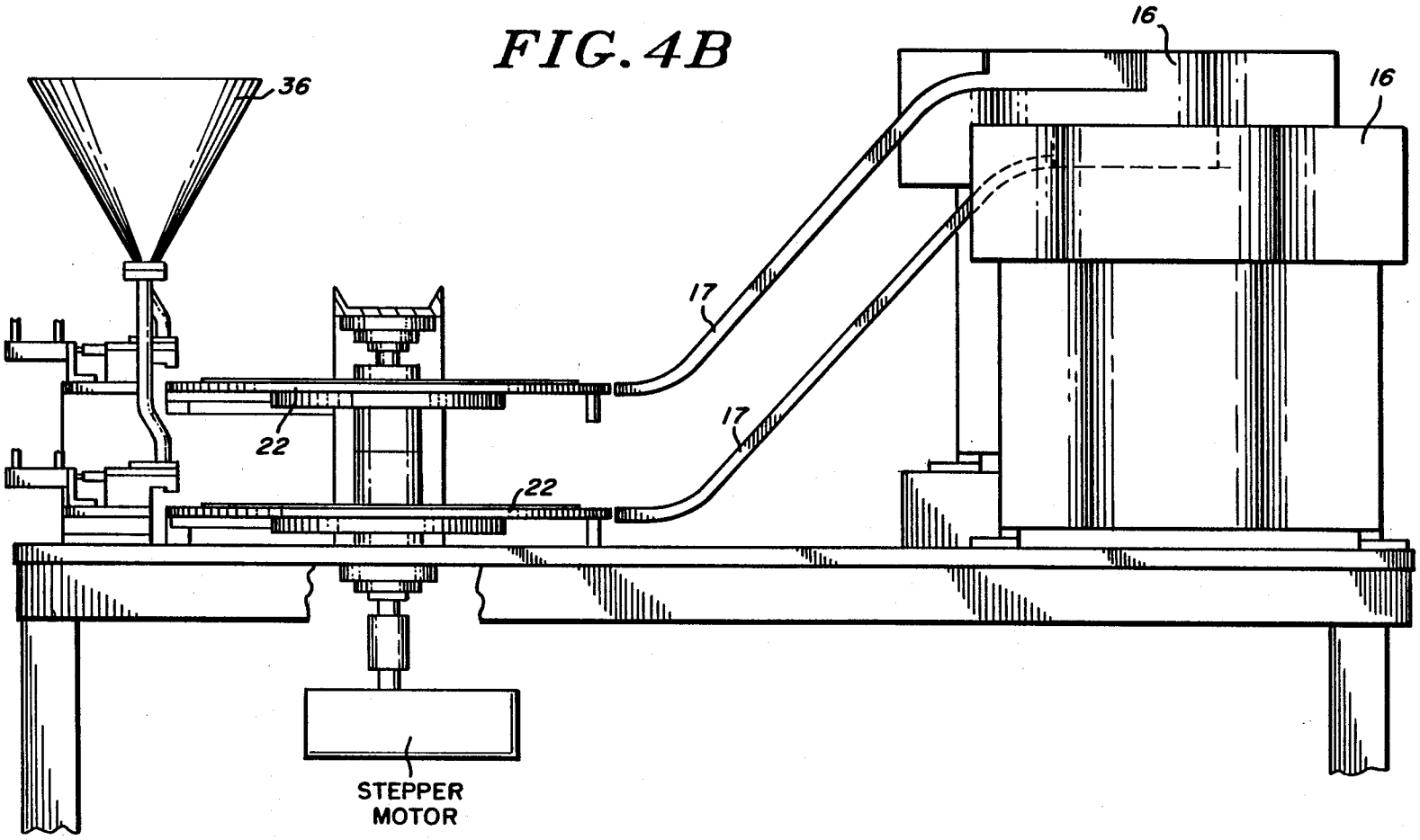

Referring to the drawings and in particular to FIGS. 1 and 4, there is generally illustrated at 10 an apparatus for applying a locking material to an internally threadable fastener 12 (hereinafter, the fastener 12). The fastener 12 as shown in FIG. 2 has an area 14 which is adapted for internal threading when coupled to an appropriately sized mating fastener, such as a screw, bolt or threaded stud (not shown). The apparatus 10 is designed to apply locking material such as, for example, nylon, teflon, or various resinous material combinations, to the internal area 14 of the fastener 12 adapted for threading during engagement with a mating fastener. The locking material preferably includes an adhesive material mixed with or attached to the locking material as, for example, described in U.S. Pat. No. 3,858,262 which is incorporated by reference herein.

The apparatus 10 in FIG. 1 includes means, such as a supply bin 16, for continuously supplying an untreated form of the fastener 12, and means for conveying, such as a trough 17 which includes a longitudinal opening 18 to receive a stack or chimney portion 19 of the fastener 12, enabling transport of the fastener 12 in a procession from the supply bin 16. The trough 17 is preferably disposed at an inclined angle to allow gravity feeding of the fastener 12, and the trough 17 preferably also includes a coupled vibrator 20 to assist in transport of the fastener 12 along the opening 18 down the inclined trough 17. In an alternative embodiment a conveyer belt (not shown) can perform the function of transporting the fastener 12.

The fasteners 12 are therefore conveyed along the trough 17 to support means, such as rotatably mounted transport table 22, which includes means for positioning the opening of the fastener 12 in preparation for application of the locking material to the area of the fastener 12 adapted for threading. This positioning means in the illustrated embodiment is a support shelf 24 rotatingly powered by conventional means and having a plurality of spaced recesses 25 for receiving and aligning the stack or chimney portion 19 (best seen in FIG. 2A and 2C) of the fasteners 12. Each of the fasteners 12 can therefore be emptied from the trough 17, aligned through positioning in the spaced recess 25 and moved along the transport table 22 for treatment.

Figure 3:
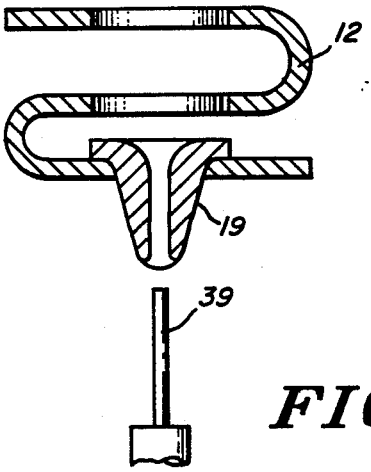
FIG. 3 shows a cross sectional view taken along line 3—3 in FIG. 2A and further including a clearance pin element.

Disposed near the transport table 22 is feed means for providing a stream of a selected type of locking material to the fastener 12 as it passes by the feed means. In the preferred embodiment the locking material is provided in a continuous stream to the fasteners 12. In alternate forms of the invention, feed means can provide a pulsed output of the locking material to the fastener 12 as it passes by the feed means. The feed means can be, for example, a locking material supply bin 34 with a funnel feed 36 and a coupled vibrator 37 for controllably filling with locking material substantially all of an opening 38 of the chimney portion 19 (see FIG. 2D) of the fastener 12. Optimally the locking material not only fills the opening 38 of the chimney portion 19, but also is present at the beginning of the throat area 40 nearest the opening 38. Furthermore, in a preferred form of the invention a clearing means is also provided, the clearing means forming a passage through the chimney portion 19 free of the locking material. The clearing means is, for example, a clearance pin 39 as shown in FIGS. 1 and 3, and is inserted into the opening 38 of the chimney portion 19 prior to the step of heating the fastener 12. A control element, such as a cammed component, (not shown) can manipulate the clearance pin 39 in a conventional manner to effectuate the clearing operation. The clearance pin 39 is preferably maintained within the chimney portion 19 until the locking material is attached to the internal area 14, such as until the fastener 12 passes through the heating step. In another form of the invention the clearance pin 39 can be used to clear a passageway through the locking material after the heating step.

The feed means position and the location where the clearance pin 39 is inserted into the fastener 12 are preferably positioned before heating means, such as an RF induction heater 30, for heating the fastener 12. As shown in FIG. 1 after alignment in one of the spaced recesses 25 and after feed means provides the locking material to the fastener 12, it is moved past a means for removing excess locking material from the fastener 12. This locking material removing means is also located before the RF induction heater 30 and functions to help achieve the desired state (described before) in which the locking material fills the opening 38 and also the beginning of the throat area 40 nearest the opening 38 (see FIG. 2C and D). The locking material removing means is, for example, a gas pressure nozzle 42 providing an air stream 43 at an angle to the horizontal as indicated in FIG. 1. A vacuum 44 collects most of the locking material removed by the air stream 43 from the fastener 12. This collected locking material can be recycled to the material supply bin 34 for future use.

The excess, unwanted locking material is thus removed by the air stream 43 from various parts of the fastener 12 and most of the throat portion 40 in order to avoid forming undesirable agglomerations of locking material on the fastener 12. In commercial use the fastener 12 receives a screw (not shown) installed blindly by a worker; therefore, the throat area 40 acts as a guide for the worker to install the screw, forming a threaded region coincident with the locking material adhering to the fastener 12. The presence of locking material on unwanted parts of the fastener 12, such as over the entire throat area 40, would make commercial assembly and use extremely difficult.

Consequently, once the excess, unwanted locking material is removed, the fastener 12 is moved by the transport table 22 to a position where heat is applied to the fastener 12 using the RF induction heater 30. The RF induction heater 30 applies radio frequency electromagnetic energy to the fastener 12 causing heating to temperatures above the softening point of the locking material. This heating of the fastener 12 causes the locking material to soften or melt, beginning with the area immediately adjacent the internal walls 14 and moving inward to the center of the opening 38 of the chimney portion 19. This softening of the locking material is sufficient to cause adherence of the locking material to the fastener area adapted for threading, such as along the internal area 14 shown in FIG. 2D. As mentioned hereinbefore, the locking material is preferably adherent not only along the internal area 14 but also on the chimney portion 19 at the beginning of the throat portion 40 nearest the opening 38.

As indicated hereinbefore in a preferred form of the invention a passageway is provided through the locking material adherent to the internal area 14. In one form of the invention the clearance pin 39 accomplishes this objective. In another form of the invention the transport table 22 includes a conduit 46 in communication with each of the spaced recesses 25. The conduit 46 cooperates to channel a gas stream, forming the desired passageway through the locking material down the center of the opening 38 of the chimney portion 19. The gas stream thus causes the discharge of excess, unattached locking material remaining after the heating step. The conduit 46 can comprise one such element moveable to perform the desired function of channeling the gas stream toward the opening 38 of the chimney portion 19 of each of the fasteners 12, or can comprise a plurality of the conduits 46 with each of the fasteners 12 having an associated one of the conduits 46. In the embodiment shown in FIG. 1, the gas stream is provided by gas pressure means, such as a gas stream nozzle 48, for directing a high pressure gas stream through the conduit 46 which channels the gas stream toward the opening of the fastener 12. A substantial portion of the excess locking material is therefore discharged from the fastener opening 38 opposite the side the gas stream is input. A portion of the discharged excess locking material is removed by vacuum exhaust means, such as a vacuum source 50.

After applying the locking material to the fastener 12, the final operation involves removal of the fastener 12 from the transport table 22 by an air blast from an air removal component 54, causing the fastener 12 to travel down an exit ramp 56 for collection.

In another form of the invention a plurality of the apparatus 10 can be utilized to treat the fasteners 12. For example, in FIGS. 4A and 4B a system having two of the apparatus 10 is illustrated with the transport table 22 having an indexed or stepped motion accomplished in a conventional manner by a stepping motor. The apparatus 10 in FIG. 4 preferably uses the clearance pin 39 to obtain the passageway through the chimney portion 14 of the fastener 12.

While preferred embodiments of the present invention have been illustrated and described, it will be understood that changes and modifications can be made therein without departing from the invention in its broader aspects. Various features of the invention are defined in the following claims.

What is claimed is:

1. An apparatus for applying material to an area adapted for threading of an internally threadable fastener having an opening and a top surface, comprising:

means for supplying for treatment a succession of said internally threadable fasteners, including means for positioning the opening of said fastener for treatment;

feed means for providing a particulate stream of said material to controllably fill substantially all of the opening of each said threadable fastener with said material;

means for directing a gaseous stream toward said top surface for removing excess material from the top surface of each said fastener, said gaseous stream displacing said material from the top surface of each said fastener prior to forming an adherent layer of said material on each said fastener;

means for heating the area adapted for threading of said internally threadable fasteners to a temperature above the softening point of said material; and means for removing unwanted portions of said material from said threadable fastener subsequent to the formation of said adherent layer of material.

2. The apparatus as defined in claim 1 further including gas pressure means for removing the finished form of said threadable fastener from said support means for collection and shipment.

3. The apparatus as defined in claim 1 further including vacuum exhaust means intercepting and drawing in for collection said excess amounts of locking material removed from the top surface and the opening of said fastener.

4. The apparatus as defined in claim 1 wherein said positioning means comprises an appropriately positioned continuously movable plurality recesses adapted to receive at least part of the said threadable fastener.

5. The apparatus as defined in claim 4 further including a conduit adapted for communication with each of said recesses, said conduit adapted to channel said gas stream and cause the discharge of a portion of the excess amounts of said unattached locking material away from said threadable fastener responsive to said gas stream.

6. The apparatus as defined in claim 5 further including a conduit in communication with said recess of each said fastener being treated, said conduit adapted to channel said gas stream and cause the discharge of at least a portion of the excess amounts of said unattached locking material away from said threadable fastener responsive to said gas stream.

7. An apparatus for applying locking material to an area adapted for threading of an internally threadable fastener having a chimney portion and a throat area, comprising:

support means for continuously moving for treatment a succession of said internally threadable fasteners, said support means including means for positioning the opening of said fastener for the treatment;

means for heating the area adapted for threading of said internally threadable fasteners to a temperature above the softening point of said locking material;

feed means for providing a particulate stream of said locking material to controllably fill substantially all the opening of each said threadable fastener with said locking material and providing formation of an adherent layer of said locking material on the area adapted for threading of said threadable fastener;

air means for removing said locking material from said throat area prior to formation of said adherent layer; and clearing means for forming a passageway through the opening of said chimney portion of said threadable fastener.

8. An apparatus for applying locking material to an area adapted for threading of an internally threadable fastener having an opening and a top surface, comprising:

means for continuously supplying an untreated form of said threadable fasteners;

means for conveying a procession of aligned threadable fasteners;

support means for receiving said threadable fasteners from said conveying means, said support means adapted for continuously moving for treatment;

means for heating the area adapted for threading of said internally threadable fasteners to a temperature above the softening point of said locking material;

feed means for providing a particulate stream of said locking material to controllably fill substantially all of the opening of each said threadable fastener with said locking material, said heating means selectively disposed before or after said feed means in the treatment of said threadable fasteners and causing formation of an adherent layer of said locking material on all the thread area of each said threadable fastener;

air means for removing substantially all of the excess locking material from the top surface of each of said fastener, said means for removing displacing substantially all of the excess locking material from the top surface of each of said fastener prior to forming an adherent layer of said locking material on each of said fastener; and gas pressure means for directing a gas stream toward the opening of each said threadable fastener to effectuate the removal from the opening of excess amounts of said locking material unattached to each said threadable fastener subsequent to causing the formation of said adherent layer of locking material.

9. An apparatus for applying material to an area adapted for threading of an internally threadable fastener having an opening and a top surface, comprising:

means for supplying for treatment a succession of said internally threadable fasteners, including means for positioning the opening of said fastener for the treatment;

feed means for providing a particulate stream of said material to controllably fill substantially all the opening of each said threadable fastener with said material;

means for blowing unwanted portions of said material from the top surface of said threadable fastener;

heating means for causing formation of an adherent layer of said material on said area adapted for threading of said threadable fastener; and means for removing unwanted portions of said material from said opening of said threadable fastener.

10. The apparatus as defined in claim 9 wherein said means for removing comprises at least one of a clearance pin and a conduit for channeling a gas stream toward the opening of said threadable fastener.

11. The apparatus as defined in claim 9 wherein said apparatus comprises a plurality of independently operable ones of said apparatus in vertically spaced relation with the others of said apparatus.

12. A method for applying material to an area adapted for threading of an internally threadable fastener having an opening and a top surface, said method comprising the steps of:

(1) supplying a succession of said internally threadable fasteners for treatment with said material;

(2) controllably filling substantially all of the opening of each said threadable fastener with a particulate stream of said material;

(3) removing excess material from the top surface of each said fastener by directing a gaseous stream toward the top surface to displace said material before said material forms an adherent layer on said fastener;

(4) heating the area adapted for threading of said fasteners to a temperature above the softening point of said material; and (5) subsequent to the formation of said adherent layer applying pressurized gas to remove unwanted portions of said material from said fasteners.

13. A method for applying locking material to an area adapted for threading of an internally threadable fastener having a chimney portion, a throat area and an opening, said method comprising the steps of:

(1) supplying a succession of said internally threadable fasteners for treatment with said locking material, wherein said support means includes means for positioning the opening of each said fastener for treatment;

(2) heating an area adapted for threading of said fasteners to a temperature above the softening point of said locking material;

(3) controllably filling substantially all of the opening of each said threadable fastener with a particulate stream of said locking material, wherein an adherent layer of said locking material is formed on the area adapted for threading of each said fastener;

(4) removing said locking material with pressurized air from said throat area prior to the formation of said adherent layer; and (5) clearing a passageway through the opening of said fastener.

14. A method for applying locking material to an area adapted for threading of an internally threadable fastener having an opening and a top surface, said method comprising the steps of:

(1) supplying an untreated form of said fasteners to a means for aligning said fasteners;

(2) aligning said fasteners;

(3) conveying said fasteners to a support means adapted for continuously moving said fasteners for treatment;

(4) selectively performing one and then the other of the following two steps:

(a) heating the area adapted for threading of said fasteners to a temperature above the softening point of said locking material;

(b) controllably filling substantially all of the opening of each said threadable fastener with a particulate stream of said locking material, wherein said heating causes an adherent layer of said locking material to form on the area adapted for threading of each said fastener;

(5) removing excess locking material from the top surface of each said fastener by directing air toward the top surface to displace substantially all said locking material before said locking material forms an adherent layer on each said fastener; and (6) directing a gas stream toward the opening of each said fastener to effectuate the removal from the opening of excess amounts of said locking material unattached to each said fastener subsequent to causing the formation of said adherent layer of locking material.

15. A method for applying material to an area adapted for threading of an internally threaded fastener having an opening and a top surface, said method comprising the steps of:

(1) supplying a succession of said internally threaded fasteners for treatment with said material;

(2) controllably filling substantially all of the opening of each said threadable fastener with a particulate stream of said material;

(3) blowing unwanted portions of said material from the top surface of said fastener;

(4) heating the area adapted for threading of said fasteners to a temperature above the softening point of said material; and (5) removing unwanted portions of said material from said opening of said fastener.

16. An apparatus for applying locking material to the area adapted for threading of an internally threadable fastener, comprising:

support means for continuously moving for treatment a succession of said internally threadable fasteners, said support means including means for positioning the opening of said fastener for the treatment;

means for heating the area adapted for threading of said internally threadable fasteners to a temperature above the softening point of said locking material;

feed means for providing a particulate stream of said locking material to controllably fill substantially all the opening of each said threadable fastener with said locking material, said heating means selectively disposed before or after said feed means in the treatment of said threadable fastener and causing formation of an adherent layer of said locking material on all the thread area of said threadable fastener;

gas pressure means selectively disposed before and after said heating means for directing a gas stream toward the opening of said threadable fastener to effectuate the removal of unwanted amounts of said locking material unattached to said threadable fastener, said support means including a conduit coupled to said positioning means for discharging a portion of the excess amounts of said unattached locking material away from said threadable fastener responsive to said gas stream.

* * * * *